United States Patent [19]

Negishi et al.

[11] Patent Number: 4,685,590

[45] Date of Patent: Aug. 11, 1987

[54] ARTICLE DISPENSING MECHANISM FOR VENDING OF CYLINDRICAL ARTICLES

[75] Inventors: Hideo Negishi; Mikiya Wakabayashi, both of Gunma, Japan

[73] Assignee: Sanden Corporation, Japan

[21] Appl. No.: 769,963

[22] Filed: Aug. 27, 1985

[30] Foreign Application Priority Data

Aug. 27, 1984 [JP] Japan ..... 59-128621[U]

[51] Int. Cl.[4] ..... B65H 31/20

[52] U.S. Cl. ..... 221/241; 221/281; 211/59.2; 312/45

[58] Field of Search ..... 221/241-242, 221/67, 281; 211/59.2, 184; 312/45, 72-73

[56] References Cited

U.S. PATENT DOCUMENTS

| | | | |
|---|---|---|---|
| 2,836,326 | 5/1958 | Childers | 221/67 |
| 3,145,066 | 8/1964 | O'Neal | 221/242 X |
| 3,361,506 | 1/1968 | Newberry | 221/242 X |
| 3,498,497 | 3/1970 | Baxendale et al. . | |
| 3,613,945 | 10/1971 | Rockola . | |
| 4,498,569 | 2/1985 | Tanaka et al. | 312/45 X |

*Primary Examiner*—Charles A. Marmor

*Attorney, Agent, or Firm*—Banner, Birch, McKie & Beckett

[57] ABSTRACT

An article dispensing mechanism for a vending machine including at least one serpentine track connected with an article loading space and an article dispensing space. The serpentine track is provided with a horizontal length adjusting device. This adjusting device comprises a spacer vertically extending within the serpentine track for defining the horizontal length of track, a movable plate connected with an upper portion of the spacer in a manner permitting sliding motion of the movable plate parallel to side plates of the machine and a guide plate extending across the loading space and engaging the movable plate. The spacer is horizontally and longitudinally slidable, following the movement of the guide plate. The position of the movable plate and the spacer defines the horizontal length of the loading space and the serpentine track.

15 Claims, 3 Drawing Figures

ARTICLE DISPENSING MECHANISM FOR VENDING OF CYLINDRICAL ARTICLES

TECHNICAL FIELD

This invention relates to an article dispensing mechanism for a vending machine and, more particularly, to a serpentine type article dispensing mechanism for the dispensing of various sizes of cylindrical articles.

BACKGROUND OF THE INVENTION

It is generally known in the art of single or double depth serpentine track dispensing mechanisms for cylindrical articles, that storage capacity is increased by utilizing the serpentine type track, without increasing the outer configuration of the article storage area. As shown in U.S. Pat. Nos. 3,498,497 and 3,613,945, each serpentine track has a meandering shape from top to bottom which causes the cylindrical articles to roll down in response to gravity from the upper end thereof to a discharge opening at the lower end thereof. Delivery of these cylindrical articles from the discharge opening is controlled by a discharge control device disposed at the discharge opening.

In a serpentine track dispensing mechanisms of the above type, the depth of each serpentine track can be slightly changed to adapt to various diameter articles, but no mechanism for adjusting the horizontal length of the track is known. Therefore, if the dimensions of the serpentine track do not correspond to the size of the dispensing articles, many problems may result, such as, the smooth rolling motion of the articles may be hindered and/or articles may obstruct the track by tipping over from their stored posture or otherwise becoming misaligned while rolling down along the track. Particularly, if the length of the articles is much shorter than the horizontal length of the serpentine track, the articles may jump the track. Thus, while rolling down the track, the articles may become damaged and/or obstruct the track.

One possible solution to the above-mentioned problems is to design many different types of serpentine track that accommodate every article size utilized in the industry. However, over the past several years the number of sizes of cylindrical articles has increased, thus this solution is not very practical.

SUMMARY OF THE INVENTION

It is a primary object of this invention to provide an improved article dispensing mechanism for vending machines that utilizes a serpentine track in which the horizontal length of the track may be adjusted to compensate for the various types of articles utilized.

It is another object of this invention to provide an article dispensing mechanism for vending machines which is simple in construction and easy to assemble.

An article dispensing mechanism for vending machines according to this invention includes a pair of side plates which face each other and define a predetermined gap therebetween, the gap forming a storage area for articles. One or more pairs of serially cusp-shaped vertical panels are supported between two side plates to form one or more serpentine tracks, each of which includes an upper end opening connected to an article loading space and a lower end opening connected with a discharge space. Each serpentine track is provided with a horizontal length adjusting device for adjusting the horizontal length of the serpentine track and the upper end opening to accommodate each size of stored articles. The adjusting device comprises a spacer vertically extending within the serpentine track, a movable plate connected with an upper portion of the spacer in a manner permitting sliding motion of the movable plate parallel to the side plates, and a guide plate extending across the upper end opening and engaged with the movable plate for guiding the movement of the movable plate. The spacer and the movable plate are movable together in a direction longitudinally between the side plates in order to define the horizontal length of the serpentine tracks and the article loading space.

DETAILED DESCRIPTION OF THE INVENTION

Figure 1:
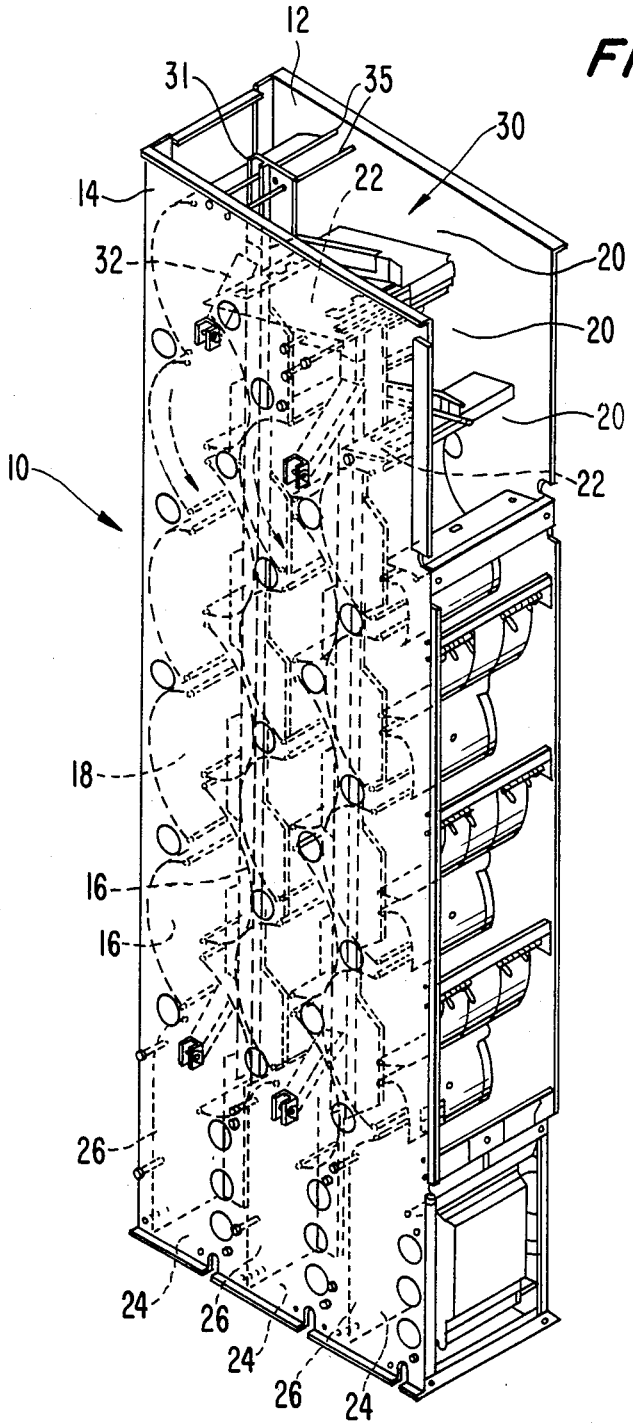
FIG. 1 is a perspective view of an article storage area of a vending machine according to an embodiment of this invention having three serpentine tracks for the dispensing mechanism.

Referring to FIG. 1, an article storage device 10 includes a pair of side plates 12 and 14 and a plurality of serially cusp-shaped vertical panels 16 which define between each pair of facing panels 16 a serpentine track 18. Side plates 12, 14 are suitably connected together to be parallel to each other and define therebetween a predetermined gap which provides spaces for article loading and discharging.

Serially cusp-shaped vertical panels 16, each of which has a plurality of semicircular cusp-shaped portions in series, are supported transversely between side plates 12, 14. Each serpentine track 18 is formed by a pair of the facing vertical panels 16 with the semicircular shaped cusp portions alternating with one another, i.e., the semicircular shaped cusp portions on one panel 16 are staggered with respect to the corresponding portions on the opposed panel 16. The width of the space defining each track is preferably slightly greater than the diameter of the maximum size article it is contemplated the dispensing mechanism will need to accommodate. Of course, it is intended that the mechanism will handle several different diameter articles.

The upper portion of each serpentine track 18 communicates with its own article loading space 20 by way of guide plates 22. The lower portion of each serpentine track 18 is connected to its own article discharging space 24 formed by guide plate 26 on which a discharge control device (not shown) is disposed.

Figure 2:
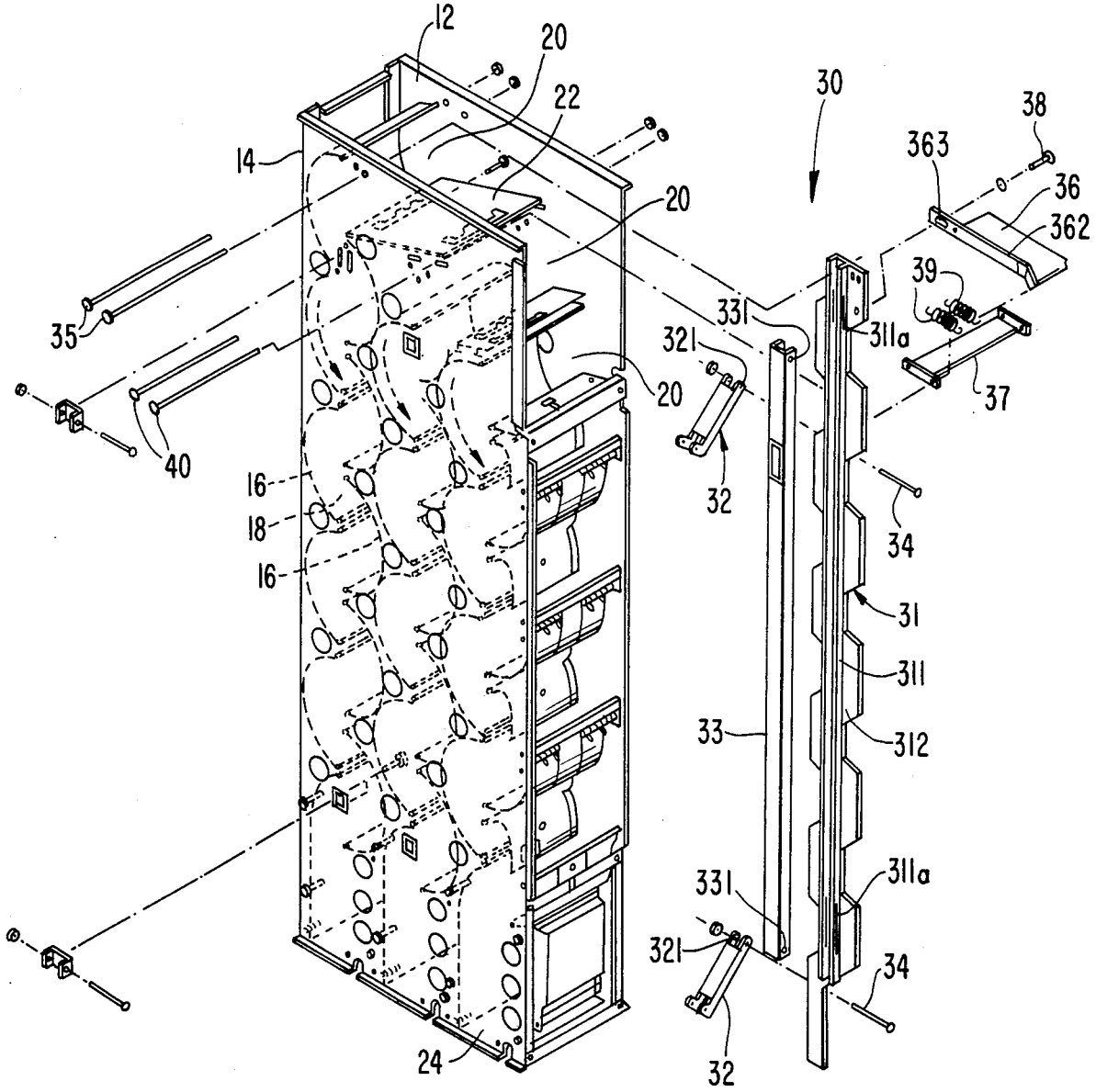
FIG. 2 is a partially exploded perspective view of an article dispensing device of FIG. 1.

As shown in FIGS. 1 and 2, each serpentine track 18 has a horizontal length adjusting device 30 which includes a side spacer 31 vertically extending within serpentine track 18. Side spacer 31 comprises a U-shaped cross sectional pole 311 and a plurality of lip portions 312 which project from both sides of pole 311, each lip portion 312 projecting toward an arc shaped portion of serpentine track 18. A pair of slant linkage devices 32 are hinged on an inner surface of one side plate 14 at its upper and lower portion and an outer end of each linkage device 32 is hinged on a connection link 33. Connection link 33 has a U-shaped cross section and is loosely engaged with pole 311 of side spacer 31 by pins 34 which pass through holes 321, 331 formed in linkage device 32 and connection link 33 and through longitudinal, vertically extending holes 311*a* formed through pole 311. A pair of guide elements 35 horizontally extend through side spacer 31 adjacent to the loading space 20. Therefore, side spacer 31 is movable within serpentine track 18 along the length guide elements 35 through the operation of linkage device 32.

Figure 3:
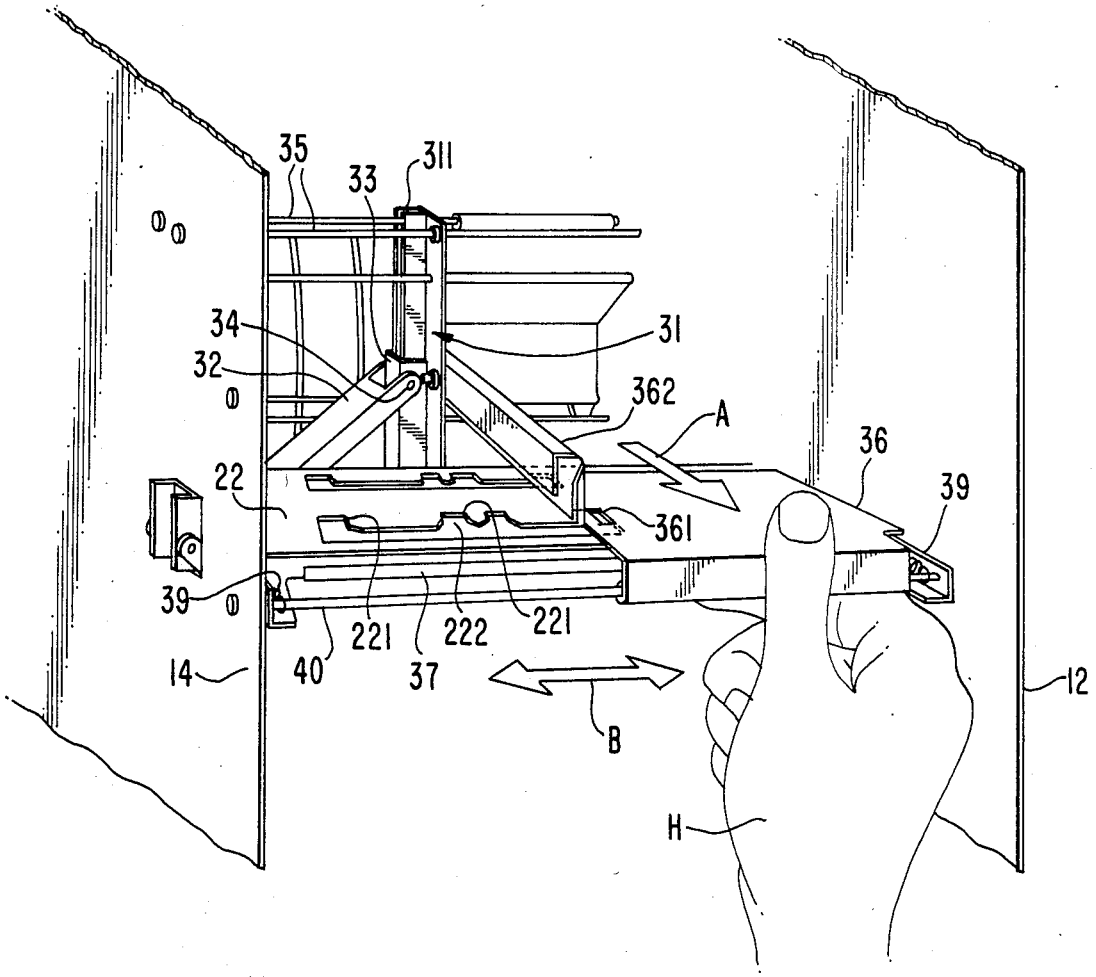
FIG. 3 is an enlarged perspective view of FIG. 1 illustrating operation of the horizontal length adjusting device.

As illustrated in FIGS. 2 and 3, a movable plate 36 is loosely attached on guide plate 22. Guide plate 22 is provided with a plurality of receiving depressions 221 and a longitudinal hole 222 connecting the receiving depressions, and a projection 361 is formed on movable plate 36 to engage one of the depressions 221. Projection 361 of movable plate 36 can be disengaged from depression 221 of guide plate 22 to slide movable plate 36 transversely so as to place projection 361 in longitudinal hole 222 thus permitting the horizontal movement of movable plate 36 along longitudinal hole 222. A flange portion 362 extends vertically outwardly from movable plate 36, and is connected with the side spacer 31 through a bolt 38. A longitudinal hole 363 is formed through flange 362 of movable plate 36 for accommodating bolt 38. Hole 363 permits movable plate 36 to slide along its length, i.e., transversely of the length of the article storage area. In cooperation with side plate 12, flange 362 determines the horizontal length of loading space 20.

A connecting plate 37 is placed under movable plate 36 in a manner to be capable of transverse sliding movement between side plates 12, and 14. Connecting plate 37 is supported on both side plates 12, 14 through a pair of support shafts 40 which horizontally extend across serpentine track 18 and through holes in flanges of connecting plate 37. Support shafts 40 also extend through longitudinally shaped holes formed on each of the side plates 12, 14. The longitudinal holes in side plates 12, 14 permit the tranverse sliding movement of connecting plate 37 along the holes, i.e., movement transverse to the longitudinal direction between side plates 12, 14, which is in a direction parallel to side plate 12, 14. Connecting plate 37 is also engaged with guide plate 22 through springs 39 which bias the connecting plate 37 against side spacer 31. At least one of the support shafts 40 is coupled to a downwardly extending flange of movable plate 36.

Referring to FIG. 3, the operation of the horizontal length adjusting device 30 will be explained. The operator (in FIG. 3, the hand H of operator is indicated) pulls the movable plate 36 and connecting plate 37 against the recoil strength of the springs 39 (this direction is illustrated by arrow A in FIG. 3). Projection 361 is disengaged from depression 221 of guide plate 22. At that time, connecting plate 37 and support shaft 40 are slidably moved together with movable plate 36 in transverse direction.

While the projection 361 and the depression 221 are disengaged, movable plate 36 may be horizontally moved along support shaft 40 to determine the horizontal length of the loading space 20 (this direction is explained by arrow B in FIG. 3). After movable plate 36 is placed in the desired position to accommodate a particular size article, the operator releases the movable plate 36. At that time, since connecting plate 37 is normally biased toward side spacer 31 due to the recoil strength of springs 39, movable plate 36 is drawn back toward side plate 31, along with connecting plate 37 and support shaft 40. Thus, projection 361 of movable plate 36 is again engaged with one of the depressions 221 of guide plate 22 for preventing further horizontal movement of movable plate 36. The result is that the horizontal length of the loading space 20 is defined by one side plate 12 and the flange portion 362 of the movable plate 36 and is adaptable to accommodate the various sizes of stored articles.

Furthermore, since movable plate 36 and side spacer 31 are connected with one another, side spacer 31 is moved in the longitudinal direction with the horizontal, longitudinal movement of movable plate 36. During this longitudinal movement, side spacer 31 remains parallel with side plate 12, 13 by means of the pair of guide elements 35 and the pair of linkage devices 32. Therefore, the horizontal length of the serpentine track 18, which is defined by side plate 12 and side spacer 31, is aligned with the length of the loading space 20 by the change in position of side spacer 31.

In summary, each sepentine track is provided with a horizontal length adjusting mechanism for adapting the horizontal length of track to the size of stored articles. This mechanism comprises a spacer with a flat stopper surface which extends vertically within the serpentine track and a movable plate with a flange portion which is engaged with a guide plate of the dispensing device and connected to the spacer. Since the spacer is connected with the movable plate, the movement of the spacer follows the longitudinal sliding motion of the movable plate. The sliding motion of the spacer is supported by a pair of linkage elements which contact the spacer through a connecting link. The movable plate is engaged with the guide plate in a manner to permit the movable plate to move parallel to the side plate of the dispensing device and to move horizontally and longitudinally across the loading space when the engagement between the guide plate and the movable plate is overcome.

The horizontal length of loading space and serpentine track is easily adjusted by the sliding operation of the movable plate thus, the horizontal length of serpentine track may adapt to the various sizes of stored articles. As as result of adjusting the horizontal length of the serpentine track, the stored articles roll smoothly down along the serpentine track without obstructing the track.

This invention has been described in detail in connection with preferred embodiments. The embodiments, however, are merely for illustrative purposes only and the present invention is not restricted thereto. It will be easily understood by those skilled in the art that other variations and modifications can easily be made, particularly in matters of size, shape and arrangment of parts, within the scope of this invention, as defined by the broad general meaning of the terms in which the appended claims are expressed.

We claim:

1. In an article dispensing mechanism for a vending machine including a pair of side plates facing one another at a predetermined spacing and at least one pair of serially cusp-shaped vertical panels disposed transversely between said side plates to define a serpentine track, an upper open end of said serpentine track being connected to an article loading space and a lower open end of said serpentine track being connected to an article dispensing space, the improvement comprising;

said serpentine track being provided with a horizontal length adjusting device including a spacer extending vertically within said serpentine track, a movable plate and a guide plate;

said movable plate being connected to an upper portion of said spacer in a manner permitting sliding motion of said movable plate parallel to said side plates; and said guide plate extending across said loading space and engaged with said movable plate for guiding the movement of said movable plate, said movable plate and said spacer being movable together in a direction longitudinally between said side plates to define the horizontal length of said serpentine track and said article loading space.

2. The article dispensing mechanism for a vending machine of claim 1 wherein said movable plate has a flange portion which defines one end of the horizontal length of said loading space, said flange portion being connected to said spacer by fastening means which penetrate a longitudinal hole formed in said flange for permitting the sliding motion of said movable plate parallel to said side plates.

3. The article dispensing mechanism for a vending machine of claim 1 wherein said guide plate has a plurality of depressions with a longitudinal hole transversely connecting said depressions, and said movable plate has a projection for removably extending into said depressions.

4. The article dispensing mechanism for a vending machine of claim 3 wherein said movable plate is biased toward said spacer.

5. The article dispensing mechanism for a vending machine of claim 1 wherein the horizontal movement of said spacer is guided by a pair of guide elements which extend across said loading space.

6. The article dispensing device of claim 1 further comprising:

a pair of support shafts extending between said side plates;

a connecting plate supported by said support shafts so as to allow said connecting plate to slide parallel to said side plates;

said connecting plate disposed beneath, and operatively coupled to, said movable plate to permit longitudinal sliding movement of said movable plate along the length of said connecting plate.

7. The article dispensing device of claim 1 wherein said guide plate has a plurality of depressions formed therein and a longitudinal hole transversely connecting said depressions; and said movable plate has a projection for selectively extending into any of said depressions so that said projection may move along the length of said longitudinal hole to facilitate the relative sliding movement between said movable plate and said guide plate thereby adjusting the horizontal length of said article loading space and, once adjusted to the desired length, said projection being securely held in the appropriate one of said depressions to maintain the adjusted length.

8. The article dispensing device of claim 6 wherein each of said side plates also has two longitudinally shaped holes through which said support shafts extend.

9. The article dispensing device of claim 1 wherein said spacer comprises a U-shaped cross-sectional pole and a plurality of lip portions projecting from both sides of pole toward each of said cuspshaped portions of said serpentine track.

10. An article dispensing device comprising:

a pair of side plates facing one another at a predetermined spacing;

a pair of serially cusp-shaped vertical panels disposed transversely between said side plates to define a serpentine track;

an article loading space connected to an upper open end of said serpentine track and an article dispensing space connected to a lower open end of said serpentine track to form a continuous path down which the article to be dispensed rolls;

a horizontal length adjusting device to adjust the horizontal length of said serpentine track and of said article loading space so as to accommodate articles of various lengths, said length adjusting device including a spacer extending vertically within said serpentine track, a movable plate, and a guide plate;

said movable plate being slideably engaged with said guide plate so as to selectively define a range of horizontal lengths of said article loading space, and said spacer being coupled to said movable plate to move with said movable plate and thereby correspondingly adjust the horizontal length of said serpentine track;

a pair of support shafts extending between said side plates;

a connecting plate supported by said support shafts so as to allow said connecting plate to slide parallel to said side plates;

said connecting plate disposed beneath, and operatively coupled to, said movable plate to permit longitudinal sliding movement of said movable plate along the length of said connecting plate.

11. An article dispensing device comprising:

a pair of side plates facing one another at a predetermined spacing;

a pair of serially cusp-shaped vertical panels disposed transversely between said side plates to define a serpentine track;

an article loading space connected to an upper open end of said serpentine track and an article dispensing space connected to a lower open end of said serpentine track to form a continuous path down which the article to be dispensed rolls;

a horizontal length adjusting device to adjust the horizontal length of said serpentine track and of said article loading space so as to accommodate articles of various lengths, said length adjusting device including a spacer extending vertically within said serpentine track, a movable plate, and a guide plate;

said spacer being formed as a U-shaped cross-sectional pole with a plurality of lip portions projecting from both sides of pole toward each of said cusp-shaped portions of said serpentine track;

said movable plate being slideably engaged with said guide plate so as to selectively define a range of horizontal lengths of said article loading space, and said spacer being coupled to said movable plate to move with said movable plate and thereby correspondingly adjust the horizontal length of said serpentine track.

12. The article dispensing device of claim 7 wherein said connecting plate is engaged with said guide plate through springs which bias said connecting plate toward said spacer.

13. The article dispensing device of claim 7 wherein said movable plate has a downwardly extending flange through which at least one of said support shafts extends.

14. The article dispensing device of claim 13 wherein said movable plate also has an upwardly extending flange with a longitudinally shaped hole which accommodates a bolt which couples said movable plate to said spacer.

15. The article dispensing device of claim 11 wherein said spacer is movable longitudinally within said serpentine track in a manner such that said spacer is always parallel to said side plates, this parallel relationship being maintained by means of a pair of slant linkage devices which are hingedly connected on an inner surface of at least one of said side plates at an upper and a lower portion thereof;

a connection link hingedly attached to an outer end of each of said slant linkage devices;

at least two holes formed in said slant linkage device and said connection link through which a connecting pin extends; and at least two longitudinally shaped holes formed in said pole through which said pins extends to couple said slant linkage devices and said connection links to said pole and to facilitate sliding movement of said spacer with respect to said serpentine track.

* * * * *